US008164261B2

(12) United States Patent
Furutani et al.

(10) Patent No.: US 8,164,261 B2
(45) Date of Patent: Apr. 24, 2012

(54) PLASMA DISPLAY PANEL

(75) Inventors: Takashi Furutani, Osaka (JP); Yukako Doi, Hyogo (JP); Yasuhiko Nakada, Osaka (JP); Hiroyuki Ajiki, Osaka (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 13/258,140

(22) PCT Filed: Feb. 15, 2011

(86) PCT No.: PCT/JP2011/000820

§ 371 (c)(1),
(2), (4) Date: Sep. 21, 2011

(87) PCT Pub. No.: WO2011/102111

PCT Pub. Date: Aug. 25, 2011

(65) Prior Publication Data

US 2012/0001540 A1 Jan. 5, 2012

(30) Foreign Application Priority Data

Feb. 22, 2010 (JP) ..... 2010-035568
Feb. 22, 2010 (JP) ..... 2010-035571
Jul. 8, 2010 (JP) ..... 2010-155645

(51) Int. Cl.
*H01J 17/49* (2006.01)

(52) U.S. Cl. ..... 313/586

(58) Field of Classification Search ..... 313/582–587; 315/169.4; 445/24; 345/60, 30, 37, 41, 47
See application file for complete search history.

(56) References Cited

U.S. PATENT DOCUMENTS

| | | | | |
|---|---|---|---|---|
| 6,614,184 | B2 * | 9/2003 | Hibino et al. | 313/586 |
| 6,888,310 | B2 * | 5/2005 | Tadaki et al. | 313/586 |
| 2001/0054871 | A1 * | 12/2001 | Tadaki et al. | 313/586 |
| 2007/0126360 | A1 | 6/2007 | Hashimoto et al. | |
| 2008/0315768 | A1 | 12/2008 | Yamakita et al. | |
| 2010/0289400 | A1 * | 11/2010 | Kuromiya et al. | 313/485 |

FOREIGN PATENT DOCUMENTS

| | | |
|---|---|---|
| JP | 9-278482 | 10/1997 |
| JP | 2002-83544 | 3/2002 |
| JP | 2003-128430 | 5/2003 |
| JP | 2003-242893 | 8/2003 |
| JP | 2007-157517 | 6/2007 |
| JP | 2007-317524 | 12/2007 |
| JP | 2009-259566 | 11/2009 |
| WO | 2006/019031 | 2/2006 |

OTHER PUBLICATIONS

International Search Report issued May 10, 2011 in International (PCT) Application No. PCT/JP2011/000820.
Written Opinion of the International Searching Authority issued May 10, 2011 in International (PCT) Application No. PCT/JP2011/000820.

* cited by examiner

*Primary Examiner* — Peter Macchiarolo
(74) *Attorney, Agent, or Firm* — Wenderoth, Lind & Ponack, L.L.P.

(57) ABSTRACT

A plasma display panel includes a front plate and a rear plate disposed so as to face the front plate. A discharge space is formed between the front plate and the rear plate. The front plate includes display electrodes and a dielectric layer formed to coat the display electrodes. The dielectric layer includes hollow fine particles which are hollowed out inside.

10 Claims, 8 Drawing Sheets

PLASMA DISPLAY PANEL

TECHNICAL FIELD

The technology disclosed herein relates to a plasma display panel used in, for example, a display device.

BACKGROUND ART

To ensure an electrical conductivity, silver electrodes are used as bus electrodes constituting display electrodes in a plasma display panel (hereinafter, called a PDP). Though low-melting glass containing lead oxide as its main ingredient is conventionally used as the material of a dielectric layer provided to coat the bus electrodes, the dielectric layers used in recent years include no lead component in view of environmental consciousness (for example, refer to Patent Document 1).

It is demanded that the capacitance of the dielectric layer be reduced to minimize reactive power so that power consumption in the PDP can be lessened, meaning that the relative dielectric constant of the dielectric layer should be reduced. According to a conventional technique employed to form the dielectric layer having a small relative dielectric constant, porous fine particles are deposited on a glass plate (for example, refer to Patent Document 2).

CITATION LIST

Patent Literature

PTL1 Unexamined Japanese Patent Publication No. 2003-128430

PTL2 Unexamined Japanese Patent Publication No. 2009-259566

SUMMARY OF THE INVENTION

A first disclosed PDP has a front plate and a rear plate disposed so as to face the front plate. The front plate includes display electrodes and a dielectric layer formed to coat the display electrodes. The dielectric layer includes hollow fine particles which are hollowed out inside and a glass layer. The hollow fine particles are dispersed in the dielectric layer.

A second disclosed PDP has a front plate and a rear plate disposed so as to face the front plate. The front plate includes display electrodes and a dielectric layer formed to coat the display electrodes. The dielectric layer includes hollow fine particles which are hollowed out inside and glass fine particles.

A third disclosed PDP has a front plate and a rear plate disposed so as to face the front plate. A discharge space is formed between the front plate and the rear plate. A discharge gas containing xenon in an amount ranging from not less than 15 vol. % to not more than 30 vol. % is enclosed in the discharge space. The front plate includes display electrodes and a dielectric layer formed to coat the display electrodes. The dielectric layer includes hollow fine particles which are hollowed out inside. The relative dielectric constant of the dielectric layer ranges from not less than 2.0 to not more than 4.0, and a film thickness thereof is not more than 20 μm.

DESCRIPTION OF EMBODIMENTS

1. Structure of PDP 1

Figure 1:
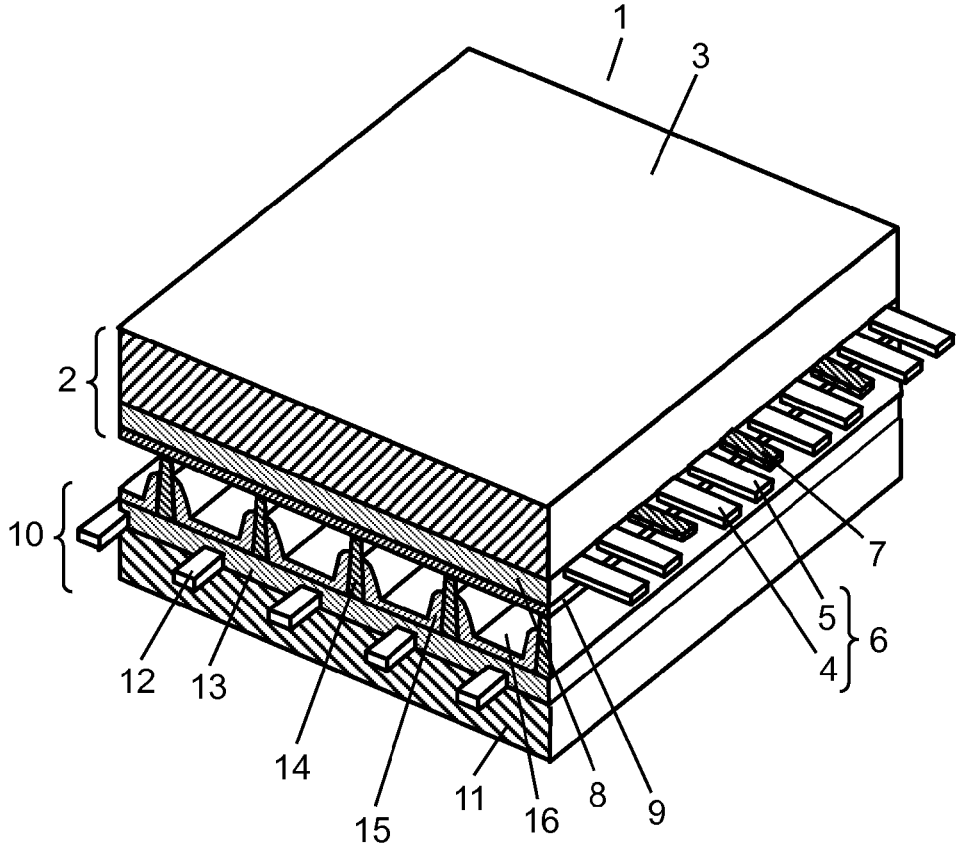
FIG. 1 is a perspective view illustrating a structure of a PDP according to an embodiment.

PDP 1 according to an embodiment of the present invention is an alternating current (AC) surface discharge PDP. As illustrated in FIG. 1, PDP 1 has a structure where front plate 2 including front glass substrate 3 and rear plate 10 including rear glass substrate 11 are disposed facing each other. Outer peripheral portions of front plate 2 and rear plate 10 are air-tightly sealed to each other by a sealing member made of, for example, glass frit. A discharge gas containing xenon (Xe) is enclosed in discharge space 16 in PDP 1 formed by the sealed panels under a pressure in the range of 55 kPa to 80 kPa.

Figure 2:
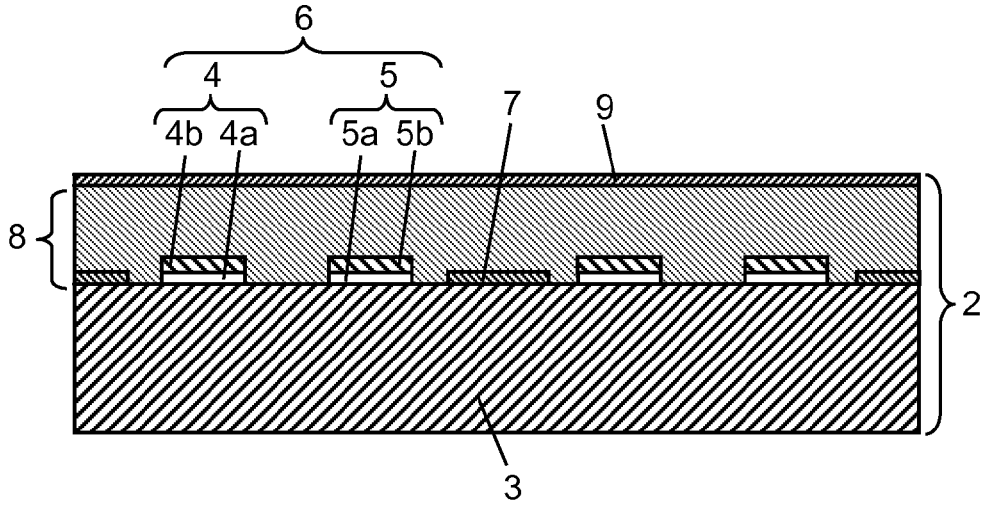
FIG. 2 is a schematic sectional view of a front plate according to the embodiment.

As illustrated in FIG. 2, a plurality of pairs of rectangular display electrodes 6 each including scan electrode 4 and sustain electrode 5 and a plurality of shielding layers 7 are provided on front glass substrate 3 in parallel with one another. Scan electrode 4 includes black electrode 4*a* and white electrode 4*b* formed on black electrode 4*a*. Sustain electrode 5 includes black electrode 5*a* and white electrode 5*b* formed on black electrode 5*a*. Dielectric layer 8 is formed on front glass substrate 3 so as to cover display electrodes 6 and shielding layers 7. Dielectric layer 8 functions as a capacitor. A surface of dielectric layer 8 is coated with protective layer 9 made of, for example, magnesium oxide (MgO).

As illustrated in FIG. 1, a plurality of rectangular address electrodes 12 are formed on rear glass substrate 11 in parallel with one another in a direction orthogonal to display electrodes 6. Address electrodes 12 are coated with insulating layer 13. Barrier ribs 14 are formed to a predetermined height on insulating layer 13 between address electrodes 12 to divide discharge space 16. Between barrier ribs 14 are serially formed; phosphor layer 15 which emits red light, phosphor layer 15 which emits blue light, and phosphor layer 15 which emits green light under ultraviolet light.

Figure 3:
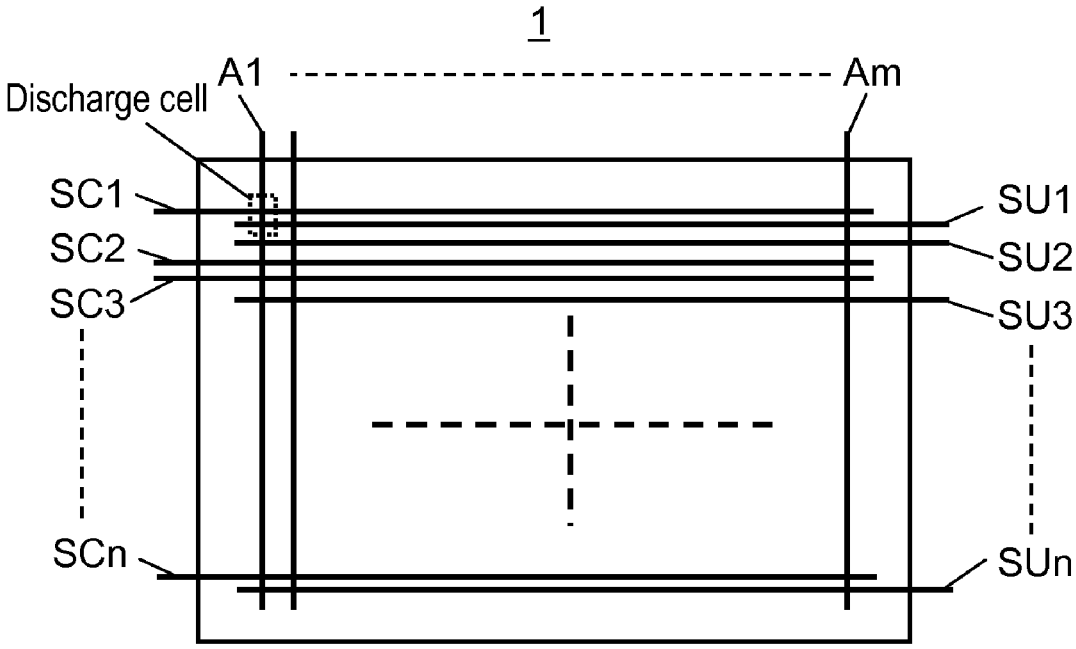
FIG. 3 is an electrode arrangement view of the PDP according to the embodiment.

As illustrated in FIG. 3, PDP 1 has n number of scan electrodes SC1 to SCn arranged so as to extend in the negative direction of Y axis, and n number of sustain electrodes SU1 to SUn arranged so as to extend in the positive direction of Y axis. Further, PDP 1 has m number of address electrodes A1 to Am arranged so as to extend in the negative direction of X axis. A discharge cell is formed at a part in which scan electrode SC1 and sustain electrode SU1 intersect with address electrode A1, and there are m×n discharge cells in the discharge space. The sustain electrodes and the scan electrodes are connected to connection terminals provided in a marginal portion of the front plate on the outer side of an image display region. The address electrodes are connected to connection terminals provided in a marginal portion of the rear plate on the outer side of the image display region.

2. Driving Method of PDP 1

Figure 4:
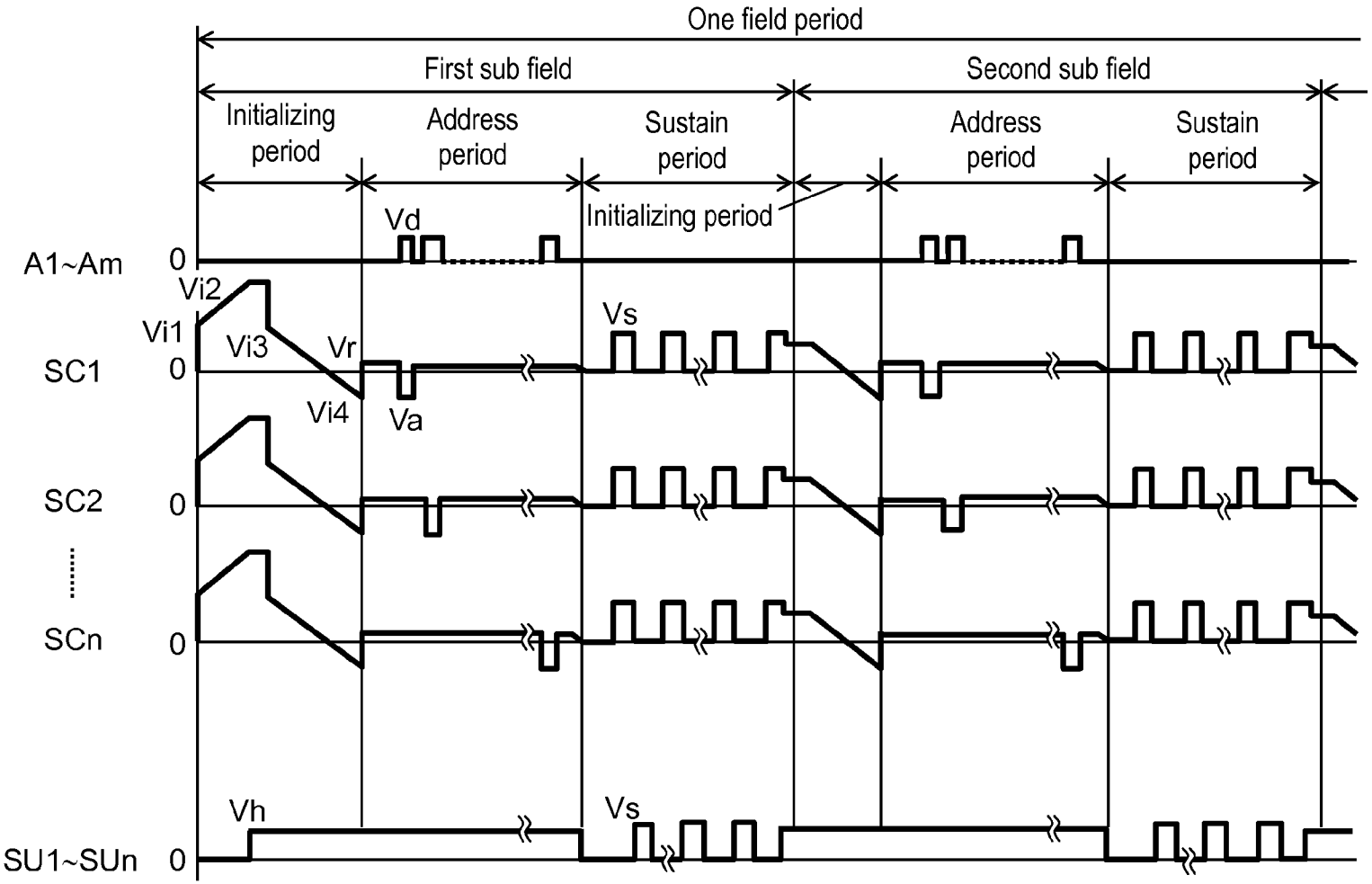
FIG. 4 is a drive voltage waveform chart of the PDP according to the embodiment.

As illustrated in FIG. 4, PDP 1 according to the present embodiment is driven by a sub field driving method. According to the sub field driving method, one field includes a plurality of sub fields. Each sub field has an initializing period, an address period, and a sustain period. The initializing period is a period for generating initializing discharge in the discharge cells. The address period, which follows the initializing period, is a period for generating address discharge to select the discharge cell to become luminescent. The sustain period is a period for making the discharge cell selected in the address period generate sustain discharge.

2-1-1. Initializing Period

During the initializing period of a first sub field, address electrodes A1 to Am and sustain electrodes SU1 to SUn are kept at 0 (V). A ramp voltage moderately elevating from voltage Vi1 (V) equal to or below a discharge start voltage to voltage Vi2 (V) exceeding the discharge start voltage is applied to scan electrodes SC1 to SCn. Then, a first round of very weak initializing discharge is generated in all of the discharge cells. As a result of the initializing discharge, negative wall voltages are stored on scan electrodes SC1 to SCn, and positive wall voltages are stored on sustain electrodes SU1 to SUn and address electrodes A1 to Am. The wall voltage is a voltage generated by wall charges stored on, for example, protective layer 9 and phosphor layers 15.

After that, sustain electrodes SU1 to SUn are kept at positive voltage Vh (V). A ramp voltage moderately declining from voltage Vi3 (V) to voltage Vi4 (V) is applied to scan electrodes SC1 to SCn. Then, a second round of very weak initializing discharge is generated in all of the discharge cells, and wall voltages between scan electrodes SC1 to SCn and sustain electrodes SU1 to SUn are thereby weakened. The wall voltages on address electrodes A1 to Am are adjusted to values suitable for a address operation.

2-1-2. Address Period

During the address period subsequent to the initializing period, scan electrodes SC1 to SCn are temporarily kept at Vr (V). Then, negative scan pulse voltage Va (V) is applied to scan electrode SC1 in the first row, and positive address pulse voltage Vd (V) is applied to address electrode Ak (k=1 to m) of the discharge cell to be displayed on the first row among address electrodes A1 to Am. A voltage at the intersection of address electrode Ak with scan electrode SC1 then results in a voltage value obtained by adding the wall voltage on address electrode Ak and the wall voltage on scan electrode SC1 to an externally applied voltage (Vd to Va) (V), meaning that the voltage at the intersection of address electrode Ak with scan electrode SC1 exceeds the discharge start voltage. Then, the address discharge is generated between address electrode Ak and scan electrode SC1 and also between sustain electrode SU1 and scan electrode SC1. Then, a positive wall voltage is stored on scan electrode SC1 of the discharge cell where the address discharge was generated, a negative wall voltage is stored on sustain electrode SU1 of the discharge cell where the address discharge was generated, and a negative wall voltage is stored on address electrode Ak of the discharge cell where the address discharge was generated.

The voltages at the intersections of address electrodes A1 to Am with scan electrode SC1, to which address pulse voltage Vd (V) was not applied, stay below the discharge start voltage. Therefore, the address discharge is not generated in the relevant discharge cells. The address operation described so far is performed to all of the discharge cells up to the nth row. The address period ends when the address operation in the discharge cell on the nth row is completed.

2-1-3. Sustain Period

During the sustain period subsequent to the address period, positive sustain pulse voltage Vs (V) is applied as a first voltage to scan electrodes SC1 to SCn, and a ground potential, that is 0 (V), is applied as a second voltage to sustain electrodes SU1 to SUn. In any discharge cell where the address discharge is generated then, a voltage between scan electrode SCi and sustain electrode SUi results in a voltage value obtained by adding the wall voltage on scan electrode SCi and the wall voltage on sustain electrode SUi to sustain pulse voltage Vs (V), which exceeds the discharge start voltage. Then, the sustain discharge is generated between scan electrode SCi and sustain electrode SUi. The sustain discharge generates ultraviolet light, and the generated ultraviolet light excites the phosphor layers, making them emit the light. A negative wall voltage is stored on scan electrode SCi, a positive wall voltage is stored on sustain electrode SUi, and a positive wall voltage is stored on address electrode Ak.

There is no sustain discharge in any of the discharge cells where the address discharge was not generated during the address period. Therefore, the wall voltages when the initializing period ends are retained therein. Then, the second voltage, that is 0 (V), is applied to scan electrodes SC1 to SCn. The first voltage, that is sustain pulse voltage Vs (V), is applied to sustain electrodes SU1 to SUn. In any discharge cell where the sustain discharge is generated then, a voltage between sustain electrode SUi and scan electrode SCi exceeds the discharge start voltage, and the sustain discharge is generated again between sustain electrode SUi and scan electrode SCi. Therefore, a negative wall voltage is stored on sustain electrode SUi, and a positive wall voltage is stored on scan electrode SCi.

Similarly, such a number of sustain pulse voltages Vs (V) that are responsive to luminance weights are thus applied to scan electrodes SC1 to SCn and sustain electrodes SU1 to SUn alternately, so that the sustain discharge is continuously generated in the discharge cells where the address discharge was generated during the address period. When the application of a predetermined number of sustain pulse voltages Vs (V) is completed, the sustain operation during the sustain period ends.

2-1-4. Second Sub Field and Fields Thereafter

During the initializing period, address period, and sustain period in and after a second sub field, operations substantially similar to the operations in the first sub field are performed. Therefore, detailed description of these operations is omitted. In and after the second sub field, a selective initializing operation may be performed, in which the initializing discharge is selectively generated only in the discharge cells where the sustain discharge was generated in the previous sub field. According to the present embodiment, the selective initializing operation and all-cell initializing operation may be separately carried out in the first sub field and the other sub fields. However, the all-cell initializing operation may be carried out during the initializing period in the sub fields other than the first sub field or may be carried out by such a frequency as once in every several fields.

3. Production Method of PDP 1

3-1. Production Method of Front Plate 2

As illustrated in FIG. 2, scan electrodes 4, sustain electrodes 5, and black stripes 7 are formed on front glass substrate 3 by photolithography. Scan electrode 4 and sustain electrode 5 respectively have white electrodes 4*b* and 5*b* including silver (Ag) to ensure an electrical conductivity. Scan electrode 4 and sustain electrode 5 further have black electrodes 4*a* and 5*a* including a black pigment for contrast enhancement on an image display screen. White electrode 4*b* is provided on black electrode 4*a*, and white electrode 5*b* is provided on black electrode 5*a*.

A material used to form black electrodes 4*a* and 5*a* is, for example, a black paste containing a black pigment to ensure blackness, a glass frit to bind a black pigment, a photosensitive resin, and a solvent. The black paste is spread on front glass substrate 3 by, for example, screen printing. Then, the solvent in the black paste is removed in a baking oven, and the black paste is exposed to light via a photo mask formed in a predetermined pattern.

A material used to form white electrodes 4*b* and 5*b* is, for example, a white paste containing silver (Ag), a glass frit to bind the silver, a photosensitive resin, and a solvent. The white paste is spread by, for example, screen printing on front glass substrate 3 where the black paste is spread. Then, the solvent in the white paste is removed in a baking oven, and the white paste is exposed to light via a photo mask formed in a predetermined pattern.

Then, the black paste and the white paste are developed so that a black electrode pattern and a white electrode pattern are formed. Lastly, the black electrode pattern and the white electrode pattern are fired in a baking oven at a predetermined temperature so that the photosensitive resins in the black electrode pattern and the white electrode pattern are removed. Further, the glass frit in the black electrode pattern is melted, and the melted glass frit starts to vitrify again after the firing, and the glass frit in the white electrode pattern is melted, and the melted glass frit starts to vitrify again after the firing. As a result of these steps, black electrodes 4*a* and 5*a* and white electrodes 4*b* and 5*b* are formed.

Black stripes 7 are formed in production steps similar to those of black electrodes 4*a* and 5*a*. Black stripes 7 may be formed at the same time as the formation of black electrodes 4*a* and 5*a*. In place of screen printing employed to apply the black electrode paste and the white electrode paste, sputtering or vapor deposition may be employed.

Next, dielectric layer 8 is formed so as to cover scan electrode 4, sustain electrodes 5, and shielding layers 7. Dielectric layer 8 will be described in detail later.

Then, protective layer 9 made of magnesium oxide (MgO) is formed on dielectric layer 8. An EB (Electron Beam) evaporation apparatus, for example, is used to form protective layer 9. A material used to form protective layer 9 is a pellet made of single-crystalline MgO. The pellet may further contain, for example, aluminum (Al) or silicon (Si) as an impurity.

First, an electron beam is applied to the pellet placed in a deposition chamber of the EB evaporation apparatus. The pellet is vaporized under the energy from the electron beam. The vaporized MgO is adhered to dielectric layer 8 placed in the deposition chamber. The thickness of the MgO film is adjusted to stay within a predefined range by changing the intensity of the electron beam or the pressure of the deposition chamber.

Examples of protective layer 9 that can be used other than the MgO film are a mixture film containing MgO and calcium oxide (CaO), a film including a metallic oxide such as strontium oxide (SrO), barium oxide (BaO), or aluminum oxide ($Al_2O_3$), and a film including a plurality of metallic oxides.

Thus, the production of front plate 2 where the structural elements described so far are provided on front glass substrate 3 is completed.

3-2. Production Method of Rear Plate 10

As illustrated in FIG. 1, address electrodes 12, insulating layer 13, barrier ribs 14, and phosphor layers 15 are formed on rear glass substrate 11.

To start with, address electrodes 12 are formed on rear glass substrate 11 by photolithography. A material used to form address electrodes 12 is, for example, an address electrode paste containing silver (Ag) to ensure conductivity, a glass frit to bind the silver, a photosensitive resin, and a solvent. First, the address electrode paste is spread in a predetermined thickness on rear glass substrate 11 by, for example, screen printing, and the solvent in the address electrode paste is removed in a baking oven. Then, the address electrode paste is exposed to light via a photo mask formed in a predetermined pattern, and the address electrode paste is developed so that an address electrode pattern is formed. Lastly, the address electrode pattern is fired in a baking oven at a predetermined temperature so that the photosensitive resin in the address electrode pattern is removed. Further, the glass frit in the address electrode pattern is melted, and the melted glass frit starts to vitrify again after the firing. As a result of these steps, address electrodes 12 are formed. In place of screen printing employed to apply the address electrode paste, sputtering or vapor deposition may be employed.

Next, insulating layer 13 is formed. A material used to form insulating layer 13 is, for example, a base dielectric paste containing a dielectric glass frit, a resin, and a solvent. First, the base dielectric paste is spread by, for example, screen printing in a predetermined thickness on rear glass substrate 11 where address electrodes 12 are formed so as to cover address electrodes 12. Then, the solvent in the base dielectric paste is removed in a baking oven. Lastly, the base dielectric paste is fired in a baking oven at a predetermined temperature so that the resin in the base dielectric paste is removed. Further, the dielectric glass frit is melted, and the melted dielectric glass frit starts to vitrify again after the firing. As a result of these steps, insulating layer 13 is formed. In place of screen printing employed to apply the base dielectric paste, die coating or spin coating may be employed. Instead of using the base dielectric paste, a film used as insulating layer 13 may be formed by, for example, CVD (Chemical Vapor Deposition).

Next, barrier ribs 14 are formed by photolithography. A material used to form barrier ribs 14 is, for example, a barrier rib paste containing a filler, a glass frit to bind the filler, a photosensitive resin, and a solvent. The barrier rib paste is spread on insulating layer 13 in a predetermined thickness by, for example, die coating. Then, the solvent in the barrier rib paste is removed in a dry furnace, and the barrier rib paste is exposed to light via a photo mask formed in a predetermined pattern. The barrier rib paste is then developed so that a barrier rib pattern is formed. Lastly, the barrier rib pattern is fired at a predetermined temperature in a baking oven so that the photosensitive resin in the barrier rib pattern is removed. Further, the glass frit in the barrier rib pattern is melted, and the melted glass frit starts to vitrify again after the firing. As a result of these steps, barrier ribs 14 are formed. The photolithography may be replaced with, for example, sandblasting.

Next, phosphor layers 15 are formed. A material used to form phosphor layers 15 is, for example, a phosphor paste containing phosphor particles, a binder, and a solvent. The phosphor paste is spread by dispensing in a predetermined thickness on insulating layer 13 between adjacent barrier ribs 14 and side surfaces of barrier ribs 14. Then, the solvent in the phosphor paste is removed in a dry furnace. Lastly, the phosphor paste is fired at a predetermined temperature in a baking oven so that the resin in the phosphor paste is removed. As a result of these steps, phosphor layers 15 are formed. The dispensing may be replaced with, for example, screen printing.

As a result of the steps described so far, the production of rear plate 10 where the structural elements described so far are provided on rear glass substrate 11 is completed.

3-3. Assembling Method of Front Plate 2 and Rear Plate 10

First, a sealing member (not illustrated in the drawings) is formed by dispensing in a peripheral portion of rear plate 10. As a material of the sealing member (not illustrated in the drawings), a sealing paste containing a glass frit, a binder, and a solvent is used. The solvent in the sealing paste is removed in a dry furnace. Next, front plate 2 and rear plate 10 are disposed facing each other so that display electrodes 6 and address electrodes 12 are orthogonal to each other. Then, the peripheral portions of front plate 2 and rear plate 10 are sealed with the glass frit. Lastly, a discharge gas containing Xe by at least 15 vol. % to at most 30 vol. % is enclosed in discharge space 16. Then, the production of PDP 1 is completed.

4. Detailed Description of Dielectric Layer 8

Figure 5:
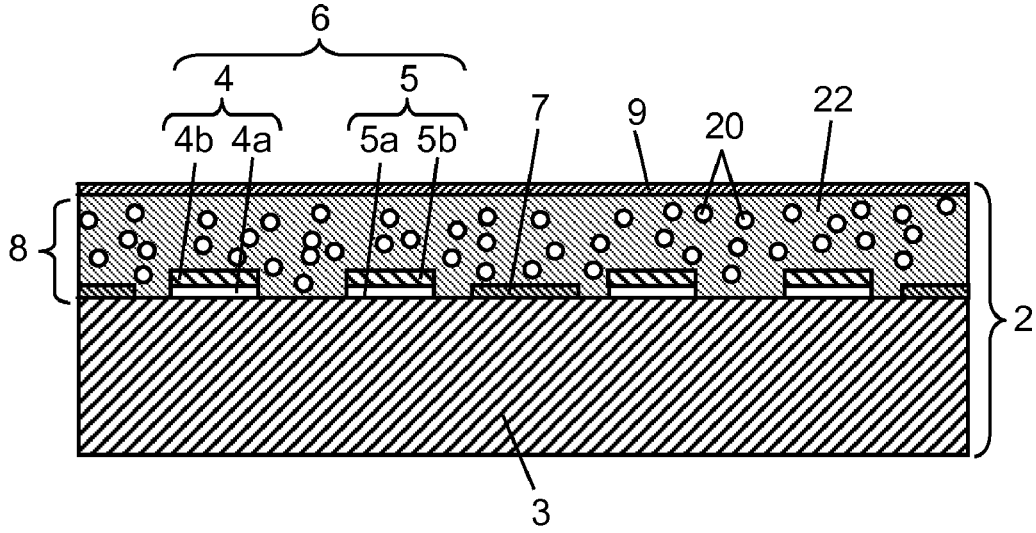
FIG. 5 is a sectional view illustrating a dielectric layer according to the embodiment.

Dielectric layer 8 is required to have a low relative dielectric constant, a high breakdown voltage, and a high light transmittance. These properties largely depend on the structure of dielectric layer 8. As illustrated in FIG. 5, dielectric layer 8 according to the present embodiment includes hollow fine particles 20 which are hollowed out inside. By way of example, dielectric layer 8 may include hollow fine particles 20 and dielectric glass layer 22 which is a glass layer. Hollow fine particles 20 are dispersed in dielectric layer 8, and hollow fine particles 20 are preferably evenly dispersed in dielectric layer 8. Note that dimensions and the number of hollow fine particles 20 illustrated in FIG. 5 may vary in actual products for ease of illustration.

As described later, whether hollow fine particles 20 are evenly dispersed in dielectric layer 8 can be determined by various measurement methods. As an example, the measurement of a visible light transmittance of front plate 2 is presented. The visible light transmittance deteriorates unless hollow fine particles 20 are evenly dispersed in dielectric layer 8. As another example, the measurement of a haze value of front plate 2 is presented. The haze value increases unless hollow fine particles 20 are evenly dispersed in dielectric layer 8.

To enable firing at the temperatures from about 450° C. to 600° C., dielectric glass conventionally included lead oxide by at least 20 wt. %. The dielectric glass according to the present embodiment, however, does not include lead oxide in view of environmental consciousness, therefore, dielectric layer 8 does not include lead oxide.

4-1. Production of Dielectric Paste

The dielectric paste includes a dielectric glass slurry in which dielectric glass fine particles are dispersed, a hollow fine particle slurry in which hollow fine particles 20 are dispersed, and a vehicle.

4-2. Dielectric Glass Slurry

The dielectric glass slurry includes the dielectric glass fine particles by 10 wt. % to 65 wt. % and a solvent by 35 wt. % to 90 wt. % mixed and dispersed therein. The dielectric glass fine particles include, for example, diboron trioxide ($B_2O_3$), silicon dioxide ($SiO_2$), potassium oxide ($K_2O$) which is an alkali metal oxide, lithium oxide ($Li_2O$), or sodium oxide ($Na_2O$). The solvent includes, for example, alcohol-based, glycol-based, or water-borne material.

The dielectric glass material having the composition containing the substances described so far is ground by wet jet milling or ball milling so that an average particle diameter is 10 nm to 100 nm, and a largest particle diameter is at most 400 nm. As a result, the dielectric glass fine particles are obtained. According to the present embodiment, the particle diameters of the dielectric glass fine particles are defined by the inscribed sphere diameter thereof. The inscribed sphere diameter is a largest diameter by which the surface of a sphere assumed to be inserted in the dielectric glass fine particle is inscribable in the dielectric glass fine particle. The produced dielectric glass fine particle has, for example, a substantially spherical shape or scale-like shape. The particle having a substantially spherical shape has an average particle diameter from 10 nm to 100 nm and a largest particle diameter equal to or below 400 nm. The particle diameter values were measured by a SEM (Secondary Eletoemission Microscopy) apparatus. To produce the dielectric glass slurry in which hollow fine particles 20 are evenly dispersed, it is preferable to regulate the particle diameters of the dielectric glass fine particles. When the average particle diameter of the dielectric glass fine particles exceeds 100 nm or the largest particle diameter thereof exceeds 400 nm, hollow fine particles 20 are unevenly distributed when dielectric layer 8 is formed because hollow fine particles 20 are distributed on the peripheral edges of the dielectric glass fine particles when the dielectric glass slurry is mixed with the hollow fine particle slurry described later, and the uneven distribution of hollow fine particles 20 remains after the firing is done. Visible light may scatter in dielectric layer 8 thus including the uneven distribution of hollow fine particles 20, deteriorating the visible light transmittance. Therefore, the average particle diameter of the dielectric glass fine particles is preferably 10 nm to 100 nm, and the largest particle diameter thereof is preferably at most 400 nm.

The dielectric glass slurry may further include a lubricant or a dispersant because the dielectric glass slurry thus including the lubricant or the dispersant can be better dispersed.

4-3. Hollow Fine Particle Slurry

Figure 6:
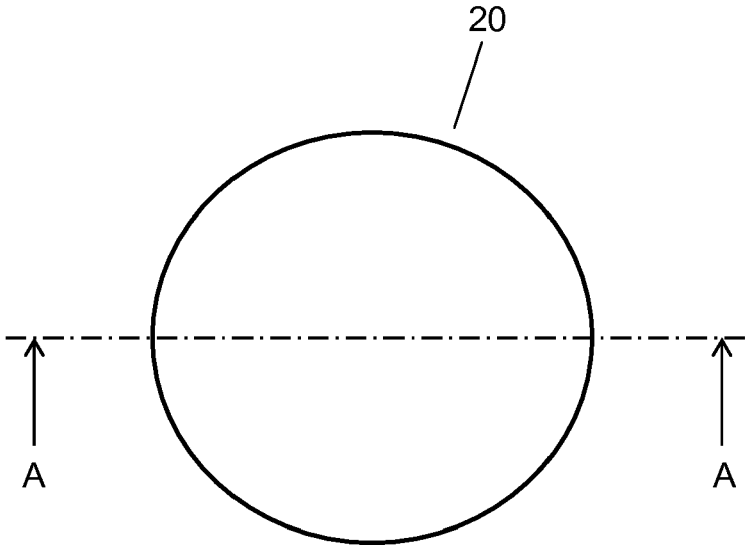
FIG. 6 is a front view of a hollow fine particle having a spherical shape.
Figure 7:
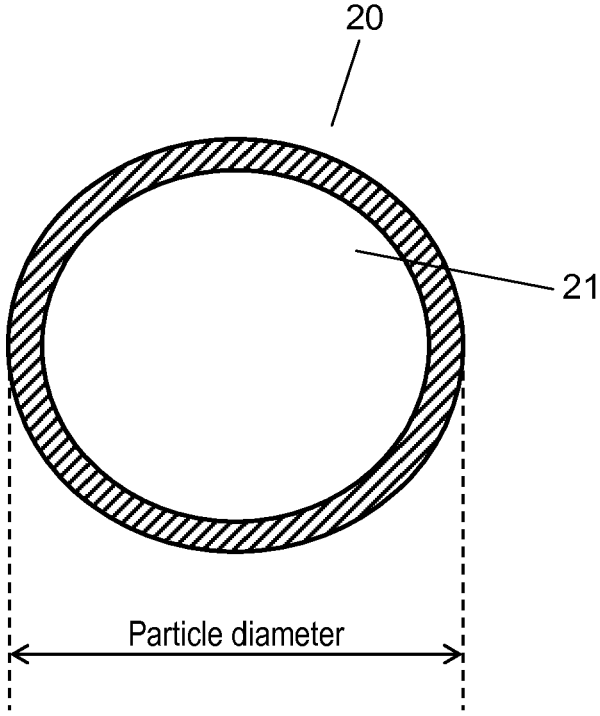
FIG. 7 is a sectional view of the hollow fine particle cut along A-A in FIG. 6.
Figure 8:
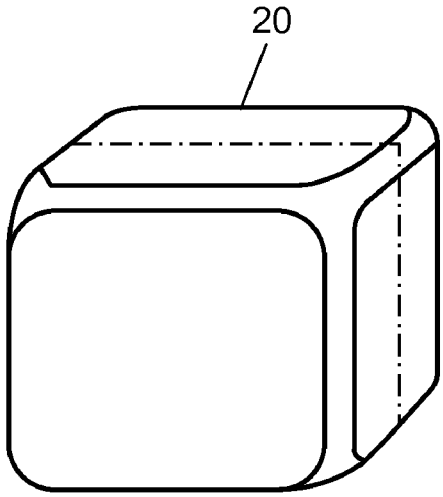
FIG. 8 is a perspective view of a hexahedral hollow fine particle.
Figure 9:
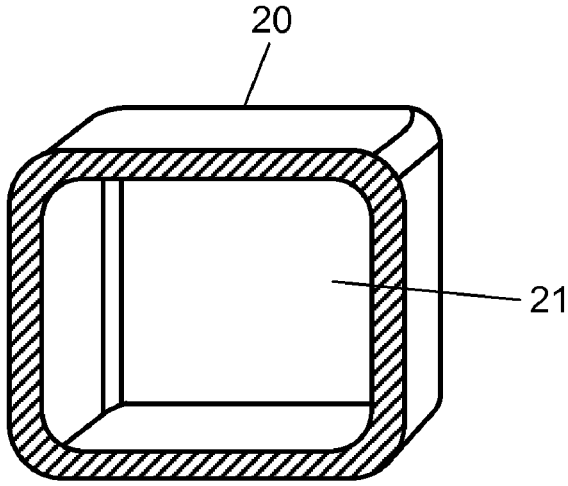
FIG. 9 is a sectional view of the hexahedral hollow fine particle cut along an alternate long and short dashed line in FIG. 8.

The hollow fine particle slurry includes hollow fine particles 20 by 1 wt. % to 20 wt. % and a solvent by 80 wt. % to 99 wt. % mixed and dispersed therein. The principal ingredient of hollow fine particle 20 is, for example, silicon dioxide ($SiO_2$), but the principal ingredient may be aluminum oxide ($Al_2O_3$), zinc oxide (ZnO), gallium oxide ($Ga_2O_3$), or a composite oxide containing these oxides. FIGS. 6 and 7 illustrate an example of hollow fine particle 20 having a spherical outer shape. As illustrated in FIG. 6, hollow fine particle 20 has a hollow structure where there is hollow portion 21 inside. The outer shape of hollow fine particle 20 is not necessarily limited to the spherical shape. FIGS. 8 and 9 illustrate hexahedral hollow fine particle 20 having a polyhedral outer shape. As illustrated in FIG. 6, hollow fine particle 20 has a hollow structure where there is hollow portion 21 inside. The shape of hollow fine particle 20 is not necessarily limited to hexahedron, and may be any other polyhedron such as octahedron. The solvent includes, for example, an alcohol-based, glycol-based, or water-borne material. The shape can be confirmed by SEM. The "spherical shape" does not necessary indicate a geometrically perfect spherical shape. The "spherical shape" indicates any shape that can be substantially recognized as a "spherical shape" through the observation of a SEM image. Similarly, the "polyhedral shape" indicates any shape that can be substantially recognized as a "polyhedral shape" through the observation of a SEM image.

According to the present embodiment, hollow fine particles 20 have an average particle diameter is not less than 10 nm and not more than 120 nm, and a largest particle diameter is not more than 400 nm. In the case of hollow fine particle 20 having the spherical shape as illustrated in FIG. 6, the particle diameter is an outer diameter of hollow fine particle 20. In the case of hollow fine particle 20 having any polyhedral shape, the particle diameter is defined by the inscribed sphere diameter thereof. The particle diameter value was measured by the SEM apparatus. As the largest particle diameter of hollow fine particles 20 increases, the visible light transmittance of the front plate deteriorates. As far as the largest particle diameter of hollow fine particles 20 is not more than 400 nm which is the shortest wavelength of visible light, the visible light transmittance thereby obtained is equal to or higher than 75%. As far as the particle diameters of hollow fine particles 20 are not more than 100 nm which is ¼ of the shortest wavelength of visible light, light scattering between hollow fine particles 20 is controlled. Therefore, the average particle diameter of hollow fine particle 20 is preferably not more than 100 nm.

Hollow fine particles 20 are preferably present by a space factor is not less than 10%, not more than 60%. In the case of the space factor less than 10%, the relative dielectric constant increases. In the case of the space factor more than 60%, hollow fine particles 20 have thinner walls, making it difficult to maintain the shapes of hollow fine particles 20. The space factor is a value obtained by dividing the volume of hollow portion 21 which is the internal space of hollow fine particle 20 by the volume of hollow fine particle 20.

Hollow fine particles 20 are produced by an organic particle plating technique or an inorganic particle plating technique. According to the organic particle plating technique, a target oxide is selectively deposited around organic core particles made of, for example, polystyrene by means of surface electric charges, and the organic core particles are removed after the surfaces of the organic core particles are coated with the oxide. According to the inorganic particle plating technique, core particles made of, for example, calcium carbonate are coated with a target oxide, and the inorganic core particles are dissolved to be removed after the surfaces of the inorganic core particles are coated with the oxide.

Whether the organic particle plating technique or inorganic particle plating technique is employed, the particle diameters and space factor of hollow fine particles 20 depend on the particle diameters of the organic core particles or the inorganic core particles and film thickness of the coating oxide. Therefore, the particle diameters and space factor of hollow fine particles 20 can be controlled when the grain size distribution of the organic core particles or inorganic core particles stays within a predetermined numeral range and the oxide film thickness stays within a predetermined numeral range. The hollow fine particle slurry may further include a lubricant or a dispersant because the hollow fine particle slurry thus including the lubricant or the dispersant can be better dispersed.

4-4. Dielectric Paste

As described so far, the dielectric glass slurry and the hollow fine particle slurry are separately produced. Before front glass substrate 3 is coated with the dielectric paste, the dielectric glass slurry and the hollow fine particle slurry are mixed and dispersed, and a binder component such as a vehicle is further mixed and dispersed, if necessary. The binder component includes ethyl cellulose or acrylic resin by 1 wt. % to 20 wt. %. The binder component further includes terpineol or butyl carbitol acetate. If necessary, dioctyl phthalate, dibutyl phthalate, triphenyl phosphate, or tributyl phosphate may be further added to the dielectric paste as a plasticizer. A material suitably selected for a solvent when the glass particles are ground may be used as the binder component. The timing of mixing and dispersing the binder component is not necessarily limited thereto.

According to the production method of the dielectric paste described so far, the dielectric glass fine particles and hollow fine particles 20 are evenly dispersed in the dielectric paste.

Hollow fine particles 20 are preferably included in dielectric layer 8 in an amount ranging from not less than 10 vol. % to not more than 74 vol. % In the case of less than 10 vol. %, it is difficult to reduce the relative dielectric constant of dielectric layer 8. In the case of more than 74 vol. %, dielectric layer 8 has a lower density, deteriorating the mechanical strength thereof, meaning that dielectric layer 8 more easily generate cracks therein. The cracks generated in dielectric layer 8 deteriorate the breakdown voltage of dielectric layer 8. To obtain that dielectric layer 8 has an enough mechanical strength, hollow fine particles 20 are preferably not more than 50 vol. %.

To include hollow fine particles 20 in dielectric layer 8 by a volume percentage within a predetermined numeral range, it is preferable that hollow fine particles 20 be included in the dielectric paste by a volume percentage within a predetermined numeral range. Therefore, the dielectric glass slurry and the hollow fine particle slurry are preferably mixed with each other by predefined proportions. An alternative way is to arrange the volume of hollow fine particles 20 included in the hollow fine particle slurry to stay within a predetermined numeral range during the production of the hollow fine particle slurry.

4-5. Formation Method of Dielectric Layer 8

Dielectric layer 8 is formed by, for example, screen printing or die coating. First, the dielectric paste is spread on front glass substrate 3. The thickness of the dielectric paste layer thus obtained is suitably set with a shrinkage caused by firing taken into account beforehand. The dielectric paste layer is dried in the temperature range of 100° C. to 200° C. Subsequently, the dielectric paste layer is dried in the temperature range of 450° C. to 600° C., more preferably in the temperature range of 550° C. to 590° C. As a result of the steps described so far, dielectric layer 8 including hollow fine particles 20 and dielectric glass layer 22 is formed.

The following method can be employed as well in the formation of dielectric layer 8. A sheet obtained by spreading the dielectric paste on a film and drying the paste is prepared. The dielectric paste formed on the sheet is transferred to front glass substrate 3 and fired in the temperature range of 450° C. to 600° C., more preferably in the temperature range of 550° C. to 590° C. As a result of these steps, dielectric layer 8 including hollow fine particles 20 and dielectric glass layer 22 is formed.

Figure 10:
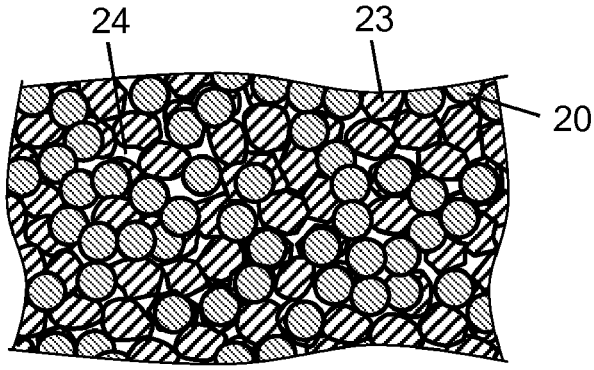
FIG. 10 is an illustration of a dielectric layer according to the embodiment.
Figure 11:
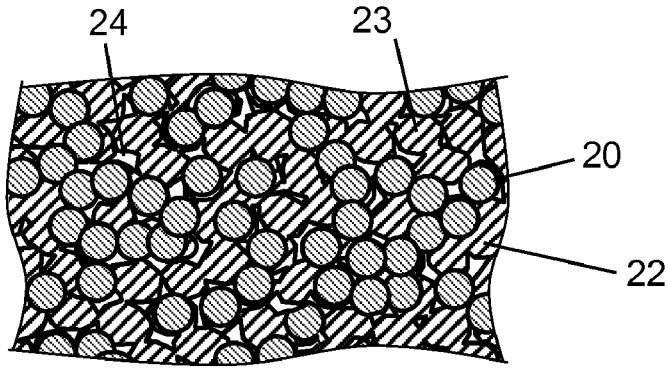
FIG. 11 is an illustration of a dielectric layer according to the embodiment.

In the case where the firing is omitted, dielectric layer 8 including hollow fine particles 20 and dielectric glass fine particles 23 which are glass fine particles is formed as illustrated in FIG. 10. In the case where the firing is performed at a firing temperature equal to or lower than the softening point of dielectric glass fine particles 23, dielectric layer 8 including hollow fine particles 20 and dielectric glass fine particles 23 is similarly formed. In the case where the firing temperature is set to a temperature near the softening point of dielectric glass fine particles 23, the firing melts a part of dielectric glass fine particles 23. The melted dielectric glass fine particles 23 start to vitrify again after the firing, and dielectric layer 8 including hollow fine particles 20, dielectric glass fine particles 23, and dielectric glass layer 22 is formed as illustrated in FIG. 11. In the event that some of dielectric glass fine particles 23 are left unmelted remain as illustrated in FIGS. 10 and 11, voids 24 are generated in dielectric layer 8. More specifically, voids 24 are left between dielectric glass fine particles 23 and hollow fine particles 20 and between dielectric glass fine particles 23. Though the relative dielectric constant of dielectric layer 8 on the whole is thereby reduced because the relative dielectric constant of voids 24 has a value somewhat close to 1.0, voids 24 present in dielectric layer 8 deteriorate the mechanical strength of dielectric layer 8. Dielectric layer 8 including hollow fine particles 20, dielectric glass fine particles 23, and dielectric glass layer 22 favorably has a low relative dielectric constant while maintaining a good mechanical strength of dielectric layer 8.

The luminance of PDP 1 improves as dielectric layer 8 has a smaller film thickness, and the discharge voltage of PDP 1 reduces as dielectric layer 8 has a smaller film thickness. Therefore, the film thickness of dielectric layer 8 is preferably smaller as far as the dielectric voltage is not thereby deteriorated. According to the present embodiment, the film thickness of dielectric layer 8 is preferably not less than 10 um, not more than 41 um to meet the required levels of the dielectric voltage and the visible light transmittance both.

4-6. Summary

PDP 1 according to the present embodiment has front plate 2 and rear plate 10. Front plate 2 and rear plate 10 are disposed facing each other. Front plate 2 includes display electrodes 6 and dielectric layer 8 formed to coat display electrodes 6. Dielectric layer 8 includes hollow fine particles 20 which are hollowed out inside. Dielectric layer 8 may include hollow fine particles 20 and dielectric glass layer 22 which is a glass layer. Hollow fine particles 20 are dispersed in dielectric layer 8.

With this configuration, dielectric glass layer 22 can ensure a good binding strength between hollow fine particles 20. Hollow fine particles 20 are hollowed out inside, therefore, the relative dielectric constant inside each particle 20 is approximately 1.0. As a result, the relative dielectric constant of hollow fine particle 20 per se is close to 1.0, thereby reducing the relative dielectric constant of dielectric layer 8.

A part of hollow fine particles 20 evenly dispersed in dielectric layer 8 may be cracked, namely fragments of hollow fine particles 20 may be scattered in dielectric layer 8. The glass does not enter hollow fine particles 20 partly cracked and opened, still leaving the hollow portions therein. Therefore, an operational effect is substantially equal whether a part of hollow fine particles 20 are cracked or uncracked. The fragments of cracked hollow fine particles 20, if entering the gaps between the dielectric glass fine particles, make a film having an improved density, thereby improving the strength of the film.

As time passes after the dielectric paste is spread, hollow fine particles 20 transfer toward the surface side of the dielectric paste layer because of its specific gravity smaller than that of the dielectric paste. When front glass substrate 3 is then dried, an inclination in the thickness direction of dielectric layer 8 is generated in the volume of hollow fine particles 20 included therein. The index of refraction of dielectric layer 8 is not adversely influenced by such an inclination of hollow fine particles 20 in the thickness direction of dielectric layer 8. The index of refraction is relatively high as less hollow fine particles 20 are included in dielectric layer 8 on the side of front glass substrate 3 thereof, whereas the index of refraction is relatively low as more hollow fine particles 20 are included in dielectric layer 8 on the surface side thereof. With this configuration, there is a smaller interfacial refraction difference between front glass substrate 3 and dielectric layer 8. Further, there is a smaller interfacial refraction difference between dielectric layer 8 and the discharge space where the discharge gas is enclosed. Therefore, an interfacial reflectivity between front glass substrate 3 and dielectric layer 8 is reduced, and an interfacial reflectivity between the discharge space and dielectric layer 8 is reduced. As a result, the light emission can be more efficiently extracted, while an incident light reflectivity is reduced.

Dielectric layer 8 may include hollow fine particles 20 and dielectric glass fine particles 23 which are glass fine particles. Further, dielectric layer 8 may include hollow fine particles 20, dielectric fine particles 23, and dielectric glass layer 22.

5. Evaluation of Working Examples

A plurality of PDPs were produced so that their performances were evaluated. The PDPs thus produced are applicable to a 42-inch high vision television. PDP 1 of working example 1 has front plate 2 and rear plate 10 disposed so as to face front plate 2. Discharge space 16 is formed between front plate 2 and rear plate 10. Front plate 2 includes display electrodes 6 and dielectric layer 8 formed to coat display electrodes 6. Dielectric layer 8 includes hollow fine particles 20. Front plate 2 further includes protective layer 9 formed to coat dielectric layer 8. Rear Plate 10 has address electrodes 12, insulating layer 13, barrier ribs 14, and phosphor layers 15. An Ne—Xe-based mixed gas containing Xe by 15 vol. % is enclosed in discharge space 16 under the internal pressure of 60 kPa. Display electrodes 6 are spaced from each other at the interval of 0.06 mm. The vertical height of barrier ribs 14 is 0.15 mm, and an interval between barrier ribs 14 (cell pitch) is 0.15 mm.

In the hollow fine particle slurry was used hollow fine particles 20 produced by the inorganic particle plating technique (principal ingredient: $SiO_2$, space factor: 50%, average particle diameter: 100 nm, largest particle diameter: 200 nm, shape: spherical shape). In the dielectric glass slurry was used dielectric glass fine particles 23 produced as described earlier (relative dielectric constant: 6.0, average particle diameter: 100 nm, largest particle diameter: 200 nm). Immediately before the dielectric paste was spread, the hollow fine particle slurry and the dielectric glass slurry were mixed with each other. The dielectric paste was spread on front glass substrate 3 by die coating. The thickness of a film formed by the spread paste was set so that dielectric layer 8 after firing had the film thickness of 15 μm. The firing was performed at a temperature equal to or higher than the softening point of dielectric glass fine particles 23. Dielectric layer 8 thus formed included hollow fine particles 20 and dielectric glass layer 22. Hollow fine particles 20 were included in dielectric layer 8 by 20 vol. %, and the relative dielectric constant of dielectric layer 8 was 4.0. The relative dielectric constant was measured by an LCR meter, and the measured value of the relative dielectric constant was obtained when the frequency was 1 kHz.

In the substrate where dielectric layer 8 was formed on front glass substrate 3, the visible light transmittance was 80%, which indicates that hollow fine particles 20 are evenly dispersed in dielectric layer 8 of working example 1. There was no dielectric breakdown of dielectric layer 8, proving that dielectric layer 8 has an enough mechanical strength. Further, power consumption in PDP 1 of the working example was cut down by 10% as compared to the PDP having a conventional dielectric layer.

The haze value of dielectric layer 8 according to working example 1 was 30%. The haze value was measured by a haze/transmittance meter "HM-150" (manufactured by Murakami Color Research Laboratory). In the working example, the light transmittance (visible light transmittance) and the haze value are measured when single-wavelength light having the wavelength of 550 nm was made incident on the front glass substrate where the dielectric layer was formed from a direction orthogonal to the front glass substrate. It is known from the haze value thus measured that hollow fine particles 20 are evenly dispersed in dielectric layer 8 according to working example 1.

The present inventors further evaluated working examples 2 and 3 in which dielectric layer 8 is configured differently to working example 1. The only difference of working example 2 to working example 1 was the firing temperature. The firing temperature was lower than the softening point of dielectric glass fine particles 23, and also set to such a temperature that the binder component contained in the dielectric paste was fully dissolved. Dielectric layer 8 according to working example 2 includes hollow fine particles 20 and dielectric glass fine particles 23. Dielectric layer 8 according to working example 2 thus mixedly including hollow fine particles 20 and dielectric glass fine particles 23 had the film thickness of 15 μm. The visible light transmittance of dielectric layer 8 according to working example 2 was equal to that of working example 1, and the relative dielectric constant thereof was lower than that of working example 1.

The only difference of working example 3 to working example 1 was the firing temperature. The firing temperature according to working example 3 was higher than that of working example 2 and set to a temperature near the softening point of dielectric glass fine particles 23. Dielectric layer 8 according to working example 3 includes hollow fine particles 20, dielectric glass fine particles 23, and dielectric glass layer 22. Dielectric layer 8 according to working example 3 had the film thickness of 15 μm. The visible light transmittance of dielectric layer 8 according to working example 3 was equal to that of working example 1. Further, the relative dielectric constant of dielectric layer 8 according to working example 3 was lower than that of working example 1, and the mechanical strength thereof was higher than that of working example 2.

PDP 1 was driven to be evaluated by the present inventors.

Sample 1 was produced in a manner similar to dielectric layer 8 according to working example 1, except the relative dielectric constant of dielectric layer 8 which was different to that of working example 1. Sample 1 included a higher percentage of hollow fine particles 20 than in working example 1, thereby reducing the relative dielectric constant to 3.0. The discharge gas used in Sample 1 includes Xe by 15 vol. %.

Sample 2 includes Xe in the discharge gas used therein by 30 vol. %. Any other aspects of Sample 2 were similar to Sample 1.

Comparative Sample is different to Sample 1 and Sample 2 in the configuration of the dielectric layer and the composition of the discharge gas used therein. The dielectric layer of Comparative Sample did not include hollow fine particles 20. More specifically, the dielectric layer of Comparative Sample consists of a dielectric glass alone which includes silicon dioxide ($SiO_2$), boron oxide ($B_2O_3$), zinc oxide (ZnO), bismuth oxide ($Bi_2O_3$), calcium oxide (CaO), strontium oxide (SrO), barium oxide (BaO), molybdenum oxide ($MoO_3$), tungsten oxide ($WO_3$), cerium oxide ($CeO_2$), or manganese dioxide ($MnO_2$). Further, Comparative Sample had the film thickness of approximately 40 μm and the relative dielectric constant of 11.3. Further, the discharge gas used in Comparative Sample included Xe by 10 vol. %.

Figure 12:
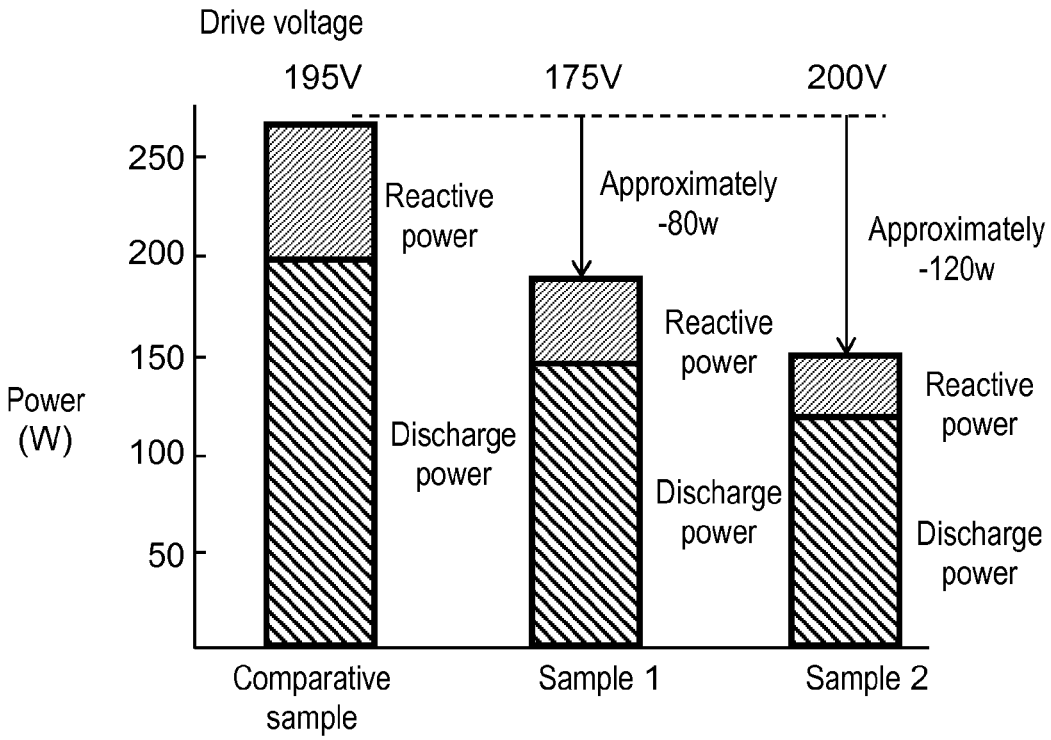
FIG. 12 is a graph illustrating drive voltages and powers in different PDPs.

Sample 1, Sample 2, and Comparative Sample were all driven to become luminescent. The drive voltage, discharge power contributing to electric discharge, and reactive power in each of the samples were measured. As illustrated in FIG. 12, Sample 1 succeeded in reducing the drive voltage by approximately 20 V as compared to Comparative Sample. Sample 1 further succeeded in reducing the power including reactive power by approximately 80 W as compared to Comparative Sample.

The drive voltage of Sample 2 was substantially equal to that of Comparative Sample, however, Sample 2 reduced the power including reactive power by approximately 120 W as compared to Comparative Sample.

Industrial Applicability

The technology disclosed in the present embodiment enables a display performance with a high image quality and reduction of power consumption in the PDP.

Reference Marks on the Drawings

1 PDP
2 front plate
3 front glass substrate
4 scan electrode
4*a*, 5*a* black electrode
4*b*, 5*b* white electrode
5 sustain electrode
6 display electrode
7 black stripe (shielding layer)
8 dielectric layer
9 protective layer
10 rear plate
11 rear glass substrate
12 address electrode
13 insulating layer
14 barrier rib
15 phosphor layer
16 discharge space
20 hollow fine particle
21 hollow portion
22 dielectric glass layer
23 dielectric glass fine particle
24 void

The invention claimed is:

1. A plasma display panel, comprising:

a front plate and a rear plate disposed so as to face the front plate, wherein the front plate includes display electrodes and a dielectric layer formed to coat the display electrodes, the dielectric layer includes hollow fine particles, which are hollowed out inside, and a glass layer, and the hollow fine particles are dispersed in the dielectric layer, wherein an average particle diameter of the hollow fine particles is not more than 100 nm and a largest particle diameter thereof is not more than 400 nm.

2. The plasma display panel according to claim 1, wherein a main ingredient of the hollow fine particles is silicon dioxide, aluminum oxide, zinc oxide, or gallium oxide, or a composite oxide containing at least one of these oxides.

3. The plasma display panel according to claim 2, wherein the hollow fine particles are included in the dielectric layer in an amount ranging from not less than 10 vol.% to not more than 74 vol.%.

4. The plasma display panel according to claim 1, wherein a relative dielectric constant of the dielectric layer ranges from not less than 2.0 to not more than 4.0, and a film thickness thereof is not more than 20 μm.

5. The plasma display panel according to claim 1, wherein the hollow fine particles have a spherical shape or a polyhedral shape.

6. A plasma display panel, comprising:

a front plate and a rear plate disposed so as to face the front plate, wherein the front plate includes display electrodes and a dielectric layer formed to coat the display electrodes, and the dielectric layer includes hollow fine particles, which are hollowed out inside, and glass fine particles, wherein an average particle diameter of the hollow fine particles is not more than 100 nm and a largest particle diameter thereof is not more than 400 nm, and an average particle diameter of the glass fine particles is not more than 100 nm and a largest particle diameter thereof is not more than 400 nm.

7. The plasma display panel according to claim 6, wherein the dielectric layer further includes a glass layer.

8. The plasma display panel according to claim 6, wherein a main ingredient of the hollow fine particles is silicon dioxide, aluminum oxide, zinc oxide, or gallium oxide, or a composite oxide containing at least one of these oxides.

9. The plasma display panel according to claim 6, wherein a relative dielectric constant of the dielectric layer ranges from not less than 2.0 to not more than 4.0, and a film thickness thereof is not more than 20 μm.

10. The plasma display panel according to claim 6, wherein the hollow fine particles have a spherical shape or a polyhedral shape.

* * * * *